US005162813A

United States Patent [19]

Kuroiwa et al.

[11] Patent Number: 5,162,813

[45] Date of Patent: Nov. 10, 1992

[54] METHOD OF AND DEVICE FOR DRIVING THERMAL HEAD IN PRINTER

[75] Inventors: Yoshihiko Kuroiwa; Toshiharu Yumoto, both of Nagano, Japan

[73] Assignee: Fuji Photo Film Co., Ltd., Kanagawa, Japan

[21] Appl. No.: 574,844

[22] Filed: Aug. 30, 1990

[30] Foreign Application Priority Data

Aug. 31, 1989 [JP] Japan ..... 1-227932

[51] Int. Cl.[5] ..... B41J 2/32

[52] U.S. Cl. ..... 346/1.1; 346/76 PH

[58] Field of Search ..... 346/76 PH, 1.1

[56] References Cited

U.S. PATENT DOCUMENTS 4,710,783 12/1987 Caine et al. ..... 400/120

FOREIGN PATENT DOCUMENTS 0077173 6/1981 Japan ..... 346/76 PH 0205179 12/1982 Japan ..... 346/76 PH

*Primary Examiner*—Benjamin R. Fuller

*Assistant Examiner*—Huan Tran

*Attorney, Agent, or Firm*—Sughrue Mion Zinn Macpeak & Seas

[57] ABSTRACT

A thermal head in a printer, which has an array of heating elements along a main scanning direction, the heating elements being drivable by a pulse signal is driven for two-dimensionally scanning a heat-sensitive medium which is moved in an auxiliary scanning direction normal to the main scanning direction, thereby recording image information on the heat-sensitive medium. The temperature of the thermal head is detected, and a change in the detected temperature is calculated per predetermined time. Thereafter, the pulse duration of a pulse supplied to the heating elements is gradually increased or reduced. Depending on the calculated change in the temperature, per each of main scanning lines within a predetermined length in the auxiliary scanning direction.

8 Claims, 11 Drawing Sheets 10
12
14
16
18
20
22
24
26
28a
28b
32(32)
36
38
40
41
42
46
47
48
50
52
54
55a
55b
56a
56b
66
68a
68b
70a
70b
72a
72b
82
84
86
88
90
92
94
100
102
104
106
A
B
C
F

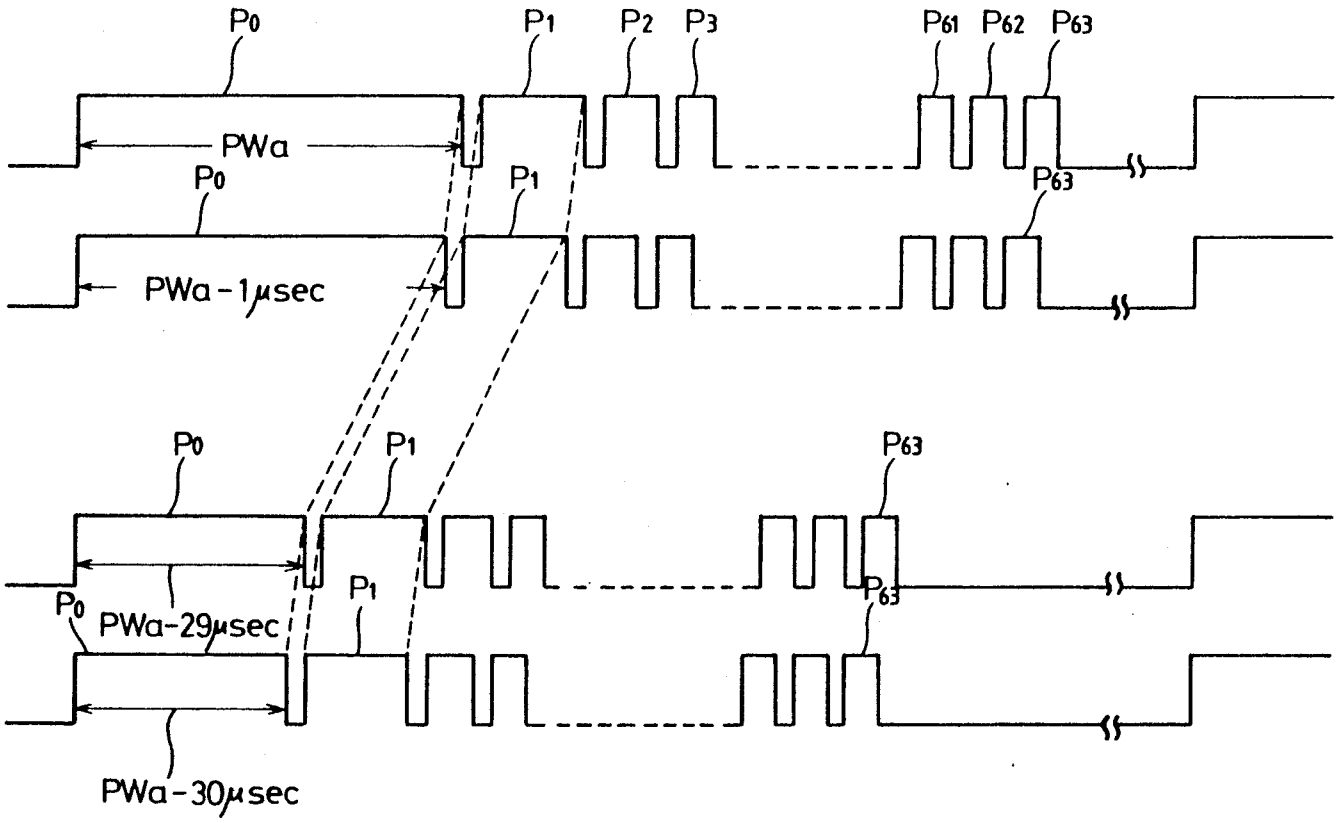
FIG.8(a) $f_k$:
FIG.8(b) $f_{k+1}$:
FIG.8(c) $f_{k+29}$:
FIG.8(d) $f_{k+30}$:

METHOD OF AND DEVICE FOR DRIVING THERMAL HEAD IN PRINTER

BACKGROUND OF THE INVENTION

The present invention relates to a method of and a device for driving a thermal head in a printer, and more particularly to a method of and a device for driving a thermal head in a printer, which thermal head comprises a linear array of heating elements arranged in a main scanning direction, by supplying the thermal head with a number of pulse signals depending on the gradations or tones of an image signal produced from an image signal recording medium such as a video floppy disk, thereby to record a two-dimensional image on a heat-sensitive body such as a heat-sensitive film, for example, which is being fed in an auxiliary scanning direction across and against the thermal head, the pulse durations of the pulse signals supplied to the thermal head being variable depending on changes in the temperature of the thermal head in order to reproduce the image in accurate rate gradiation or tones.

Various modern medical imaging diagnostic systems such as ultrasonic imaging systems, X-ray CT systems, and DF systems, in addition to the conventional X-ray imaging systems, have recently been used widely in the medical field. In such new medical imaging diagnostic systems, an ultrasonic or X-ray radiation is applied to a region of the body of a patient, and changes in the ultrasonic or X-ray radiation that has passed through the patient's body are detected to produce an image of the patient's body, which is typically displayed as a visible image on a CRT monitor. The doctor can then diagnose the region of the patient's body based on the displayed image. If necessary, other regions of the patient's body can easily be observed through the imaging system during the diagnostic process. The quick and easy imaging capability allows the diagnostic process to be performed accurately and quickly.

It is frequently necessary that the display data of the body regions which are displayed on the monitor be subsequently sent to another hospital or displayed so that any chronological changes in the imaged body region can be observed by the doctor and the patient together. To meet these requirements, the images displayed on the CRT monitor ar permanently recorded on recording mediums as hard copies. Usually, the displayed images are recorded by various printers. One of such various printers is a thermal printer which employs a light-fixable heat-sensitive film having a heat-sensitive material layer that can develop a color upon exposure to heat and can be fixed when irradiated with ultraviolet radiation.

The thermal printer accommodates a roll of light-fixable heat-sensitive film. As shown in FIG. 9 of the accompanying drawings, such light-fixable heat-sensitive film F is sent to a printing mechanism 2 which has a thermal head 6 comprising an array of as many heating elements 4 as the number of pixels to be formed, the array of heating elements 4 extending along a main scanning direction indicated by the arrow A. The light-fixable heat-sensitive film F is sandwiched between the thermal head 6 and a platen roller 8, which is rotated about its own axis in the direction indicated by the arrow B to feed the light-fixable heat-sensitive film F in an auxiliary scanning direction indicated by the arrow C. At the same time, the heating elements 4 are selectively supplied with a pulse signal based on an image signal transmitted from a medical imaging diagnostic system, thereby recording a two-dimensional image on the light-fixable heat-sensitive film F. Then, the light-fixable heat-sensitive film F is delivered to a fixing device (not shown) in which an ultraviolet lamp (not shown) is energized to apply ultraviolet radiation to the film F to fix the recorded image. The light-fixable heat-sensitive film F with one frame of image information recorded thereon is cut off to a predetermined length by a cutter (not shown), and the cut film F is fed into a discharge tray (not shown).

The light-fixable heat-sensitive film F thus cut off and carrying the reproduced image is schematically shown in FIG. 10*a*. The film F includes a hatched area which carries the reproduced image frame, the reproduced image being recorded in a printing area $L_0$ in the auxiliary scanning direction indicated by the arrow C, i.e., in the direction in which the light-fixable heat-sensitive film F is fed.

When a pulse signal whose represented image density is a constant image density $D_0$ (see FIG. 10*b*), i.e., a pulse signal representing a constant heat energy level, is continuously supplied to the heating elements 4 of the thermal head 6 with respect to all main scanning directions which cover the printing area $L_0$, the image density D is gradually increased as indicated at $D_1$ with respect to the constant density $D_0$, and as a result the reproduced image has varying image densities. The inventor has found that such a phenomenon is caused by the heat storage effect of the heating elements 4 of the thermal head 6.

SUMMARY OF THE INVENTION

It is a major object of the present invention to provide a method of and a device for driving a thermal head in a printer, by varying the pulse duration of a pulse supplied to heating elements of the thermal head depending on changes in the temperature of the thermal head, thereby compensating for changes in the density caused by the heat storage effect of the thermal head, so that when the density represented by an input image signal is constant, an image of uniform image density can be reproduced on a heat-sensitive film.

Another object of the present invention is to provide a method of driving a thermal head in a printer, which thermal head having an array of heating elements along a main scanning direction, the heating elements being drivable by a pulse signal, for two-dimensionally scanning a heat-sensitive member which is moved in an auxiliary scanning direction normal to the main scanning direction, thereby recording image information on the heat-sensitive member, the method comprising the steps of detecting the temperature of the thermal head, calculating a change in the detected temperature per predetermined time, and thereafter, gradually increasing or reducing the pulse duration of a pulse supplied to the heating elements depending on the calculated change in the temperature, per each of main scanning lines within a predetermined length in the auxiliary scanning direction.

Still another object of the present invention is to provide the method wherein the temperature of the thermal head is calculated as an average temperature while a plurality of main scanning lines being recorded by the thermal head, and the pulse duration is increased or reduced depending on a change in the average temperature.

Yet another object of the present invention is to provide the method wherein a value by which the pulse duration is to be increased or reduced is set again for a next change in the temperature of the thermal head after the pulse duration has been increased or reduced per each of main scanning lines within the predetermined length in the auxiliary scanning direction.

A further object of the present invention is to provide a device for driving a thermal head in a printer, which thermal head having an array of heating elements along a main scanning direction, the heating element being drivable a pulse signal, for two-dimensionally scanning a heat-sensitive member which is moved in an auxiliary scanning direction normal to the main scanning direction, thereby recording image information on the heat-sensitive member, the device comprising temperature detecting means for detecting the temperature of the thermal head, and control means for calculating a change in the detected temperature per predetermined time, and gradually increasing or reducing the pulse duration of a pulse supplied to the heating elements depending on the calculated change in the temperature, per each of main scanning lines within a predetermined length in the auxiliary scanning direction.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIGS. 8*a* through 8*d* are diagrams showing pulse signals applied to the heating elements of the thermal head;

DETAILED DESCRIPTION OF THE PREFERRED EMBODIMENTS

Figure 1:
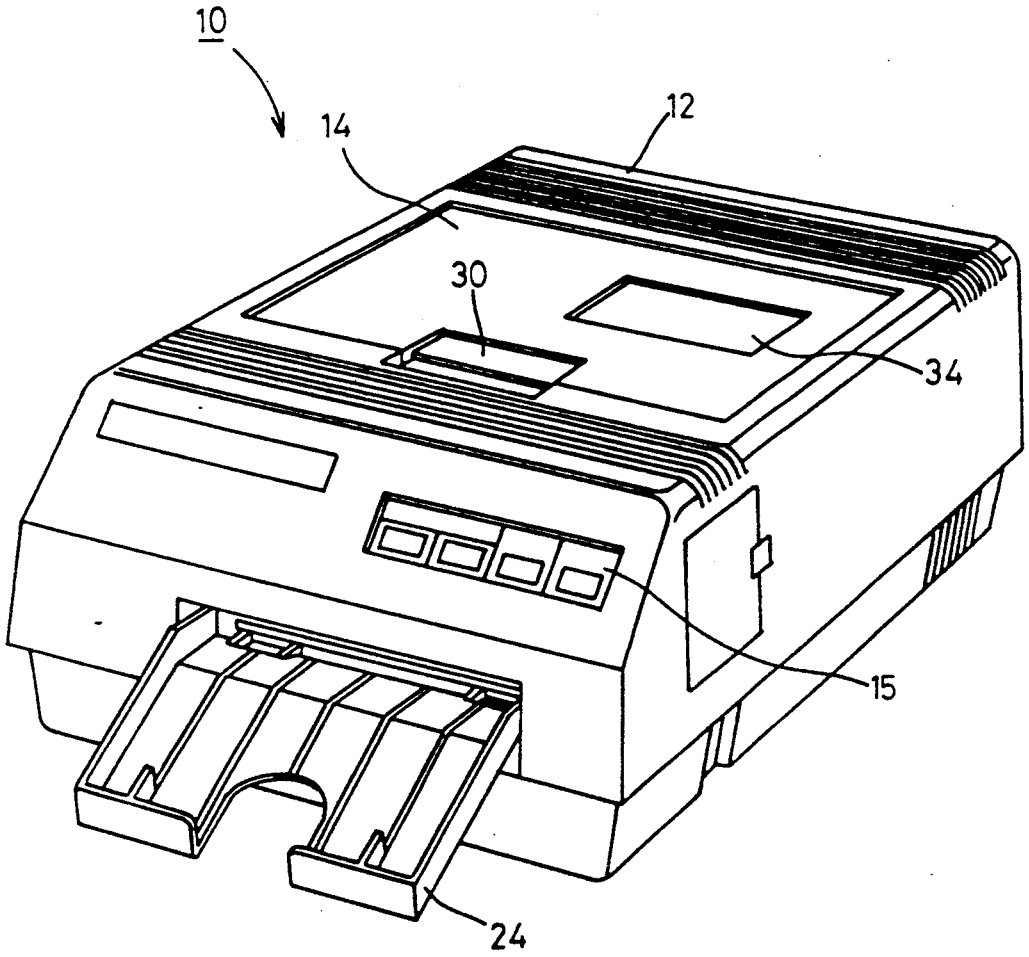
FIG. 1 is a perspective view of a printer in which a method of driving a thermal head is carried out.
Figures 2A, 2B:
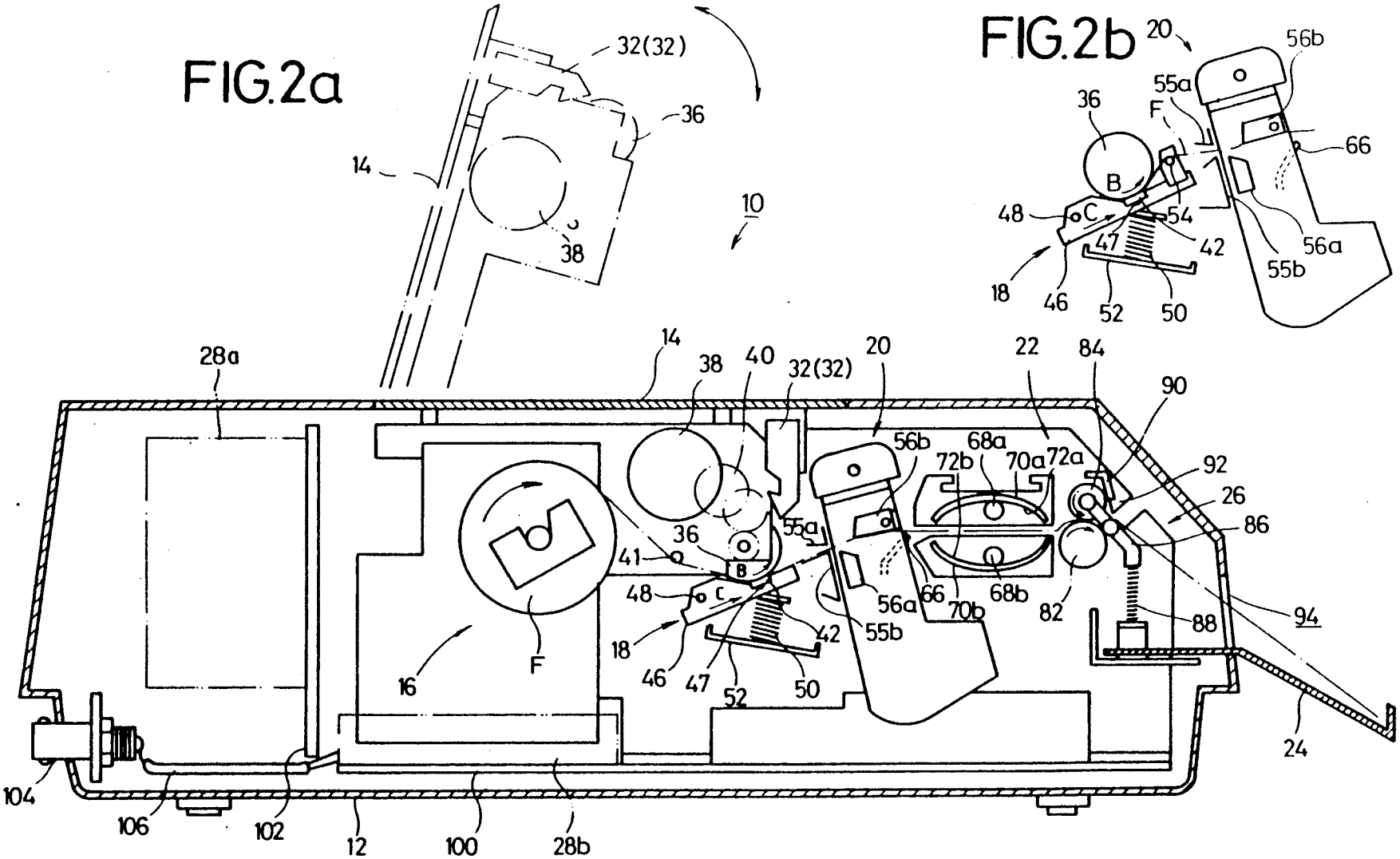
FIG. 2*a* is a vertical cross-sectional view, partly omitted from illustration, of the printer shown in FIG. 1.
FIG. 2*b* is an elevational view of a film guide, according to another embodiment of the present invention, between a printing unit and a cutter unit in the printer.

FIG. 1 shows a thermal printer 10 which incorporates a method of and a device for driving a thermal head according to the present invention. The thermal printer 10 includes a casing 12 on which there is swingably mounted a lid 14 that is pivoted at one end to an upper panel of the casing 12 so as to be openable and closable with respect to the casing 12. The casing 12 has an operation pane 15 on its front wall. As shown in FIG. 2*a*, the casing 12 accommodates therein a film loading unit 16 which stores a roll of light-fixable heat-sensitive film F, a printing unit 18 for selectively heating the light-fixable heat-sensitive film F to develop a color pattern corresponding to an image, a cutter unit 20 for cutting off the light-fixable heat-sensitive film F to a certain length, a fixing unit 22 for applying ultraviolet radiation to the light-fixable heat-sensitive film F to fix the image thereon, a discharge unit 26 for feeding the cut length of light-fixable heat-sensitive film F into a discharge tray 24, and control units 28*a*, 28*b* for controlling these units.

As shown in FIG. 1, the lid 14 has a grip 30 on its end remote from the hinged end. When the grip 30 is lifted, hooks 32 (FIG. 2*a*) on both sides of the lid 14 are turned out of engagement with the casing 12, allowing the lid 14 to be opened with respect to the casing 12. The lid 14 has an ultraviolet-cutoff filter 34 (essentially a red filter) fitted in an observation window. The ultraviolet-cutoff filter 34 allows the operator to visually check the remaining length of light-fixable heat-sensitive film F stored in the film loading unit 16.

The printing unit 18 includes a platen roller 36 (essentially rubber roller) mounted on the lower surface of the lid 14. A rotative drive source 38 such as a stepping motor is installed on one side of the lid 14 and has a rotatable drive shaft (not shown) to which a gear train 40 (indicated by the dot-and-dash lines in FIG. 2*a*) is operatively coupled. The gear train 40 is also operatively coupled to the platen roller 36 so that the platen roller 36 can be rotated in the direction indicated by the arrow B in FIG. 2*a* by the rotative drive source 38 through the gear train 40. The lid 14 also supports a rotatable guide roller 1 parallel to the platen roller 36, and also a light reflective sensor 43 (see FIG. 3) for detecting whether there is a light-fixable heat-sensitive film F or not.

Figure 3:
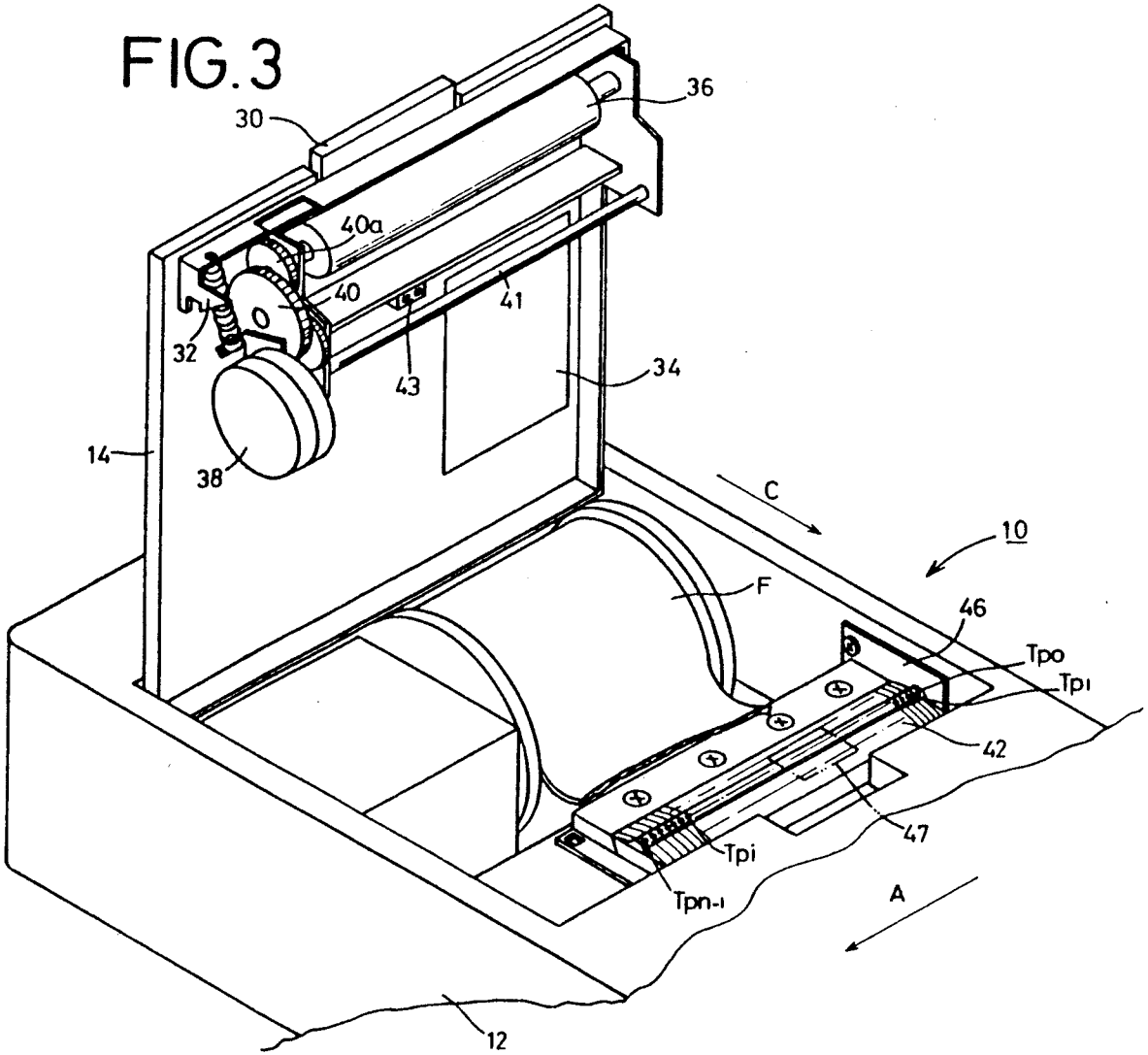
FIG. 3 is a fragmentary perspective view of the printer.

When the lid 14 is closed with respect to the casing 12 and the hooks 32 are engaged by the casing 12, the lid 14 is fixed to the casing 12, and the platen roller 36 is held against a thermal head 42. As shown in FIG. 3, the thermal head 42 comprises an array of several hundreds of heating elements Tpi (in this embodiment, n heating elements; $i=0$ through $n-1$) which correspond respectively to pixels to be formed on the light-fixable heat-sensitive film F. The thermal head 42 is fixed to a bracket 46 attached to the casing 12. A temperature detector 47 such as a thermistor is attached to the reverse side of the heating elements Tpi of the thermal head 42 in a position which is surrounded by a two-dot-and-dash line in FIG. 3. The bracket 46 is swingably supported in the casing 12 by a pin 48 near the film loading unit 16. A coil spring 50 has one end engaging a lower surface of the bracket 46 and the opposite end engaging a support plate 52 in the casing 12.

A pair of guide plates 55*a*, 55*b* is mounted on a film introduction side of the cutter unit 20 in the casing 12. The cutter unit 20 has a first fixed cutter blade 56*a* and a second movable cutter blade 56*b* which is swingable with respect to the first fixed cutter blade 56*a*.

FIG. 2*b* shows another embodiment in which a guide roller 54 is disposed between the platen roller 36 and the cutter unit 20 for protecting the thermally recorded surface of the light-fixable heat-sensitive film F. In the arrangement shown in FIG. 2*b*, the guide plate 55*b* is directed upside down. Therefore, the guide plate 55b can be used in both the arrangements shown in FIGS. 2a and 2b.

A guide member 66 is positioned near the second cutter blade 56b and has an end entering the fixing unit 22. The fixing unit 22 has a pair of ultraviolet amps 68a, 68b disposed in confronting relation to both surfaces, respectively, of the light-fixable heat-sensitive film F passing through the fixing unit 22. The ultraviolet lamps 68a, 68b are held respectively by lamp holders 70a, 70b which are of a curved shape and have inner surfaces coated with light reflecting layers 72a, 72b by the evaporation of aluminum.

The discharge unit 26 is located closely to the fixing unit 22. The discharge unit 26 includes a rotative drive source such as a stepping motor for rotating a rubber roller 82 about its own axis. A nip roller 84, which is held in rolling contact with the rubber roller 82, is rotatably supported on one end of an arm 86 that is angularly movably held in the casing 12, the other end of the arm 86 engaging a coil spring 88. Therefore, the nip roller 84 is normally urged into rolling contact with the rubber roller 82 under the resiliency of the coil spring 88. An attachment plate 90 is disposed above the nip roller 84 and supports a charge erasing brush 92 extending transversely of the light-fixable heat-sensitive film F which passes through the discharge unit 26.

The discharge tray 24 is detachably mounted in the casing 12 downstream of the rubber roller 82 with respect to the direction in which the light-fixable heat-sensitive film F is discharged by the discharge unit 26. The discharge tray 24 extends out of the casing 12 through an opening 92 which is defined in the front wall of the casing 12.

As shown in FIG. 2a, the control units 28a, 28b have respective printed-circuit boards 100, 102 which support electronic components thereon. The printed-circuit boards 100, 102 are electrically connected to the thermal head 42, the temperature detector 47, the rotative drive source 38, and the ultraviolet lamps 68a, 68b, etc. through wire harnesses (not shown). The control unit 28a is supplied with commercial electric energy from a commercial electric input terminal (not shown), and produces a DC voltage. A video signal input terminal 104 is fixed to the rear panel of the casing 12. A composite video signal Vc which is transmitted from an external medical imaging diagnostic system (not shown) is delivered from the video signal input terminal 104 through a signal cable 106 to the control unit 26b.

Figure 4:
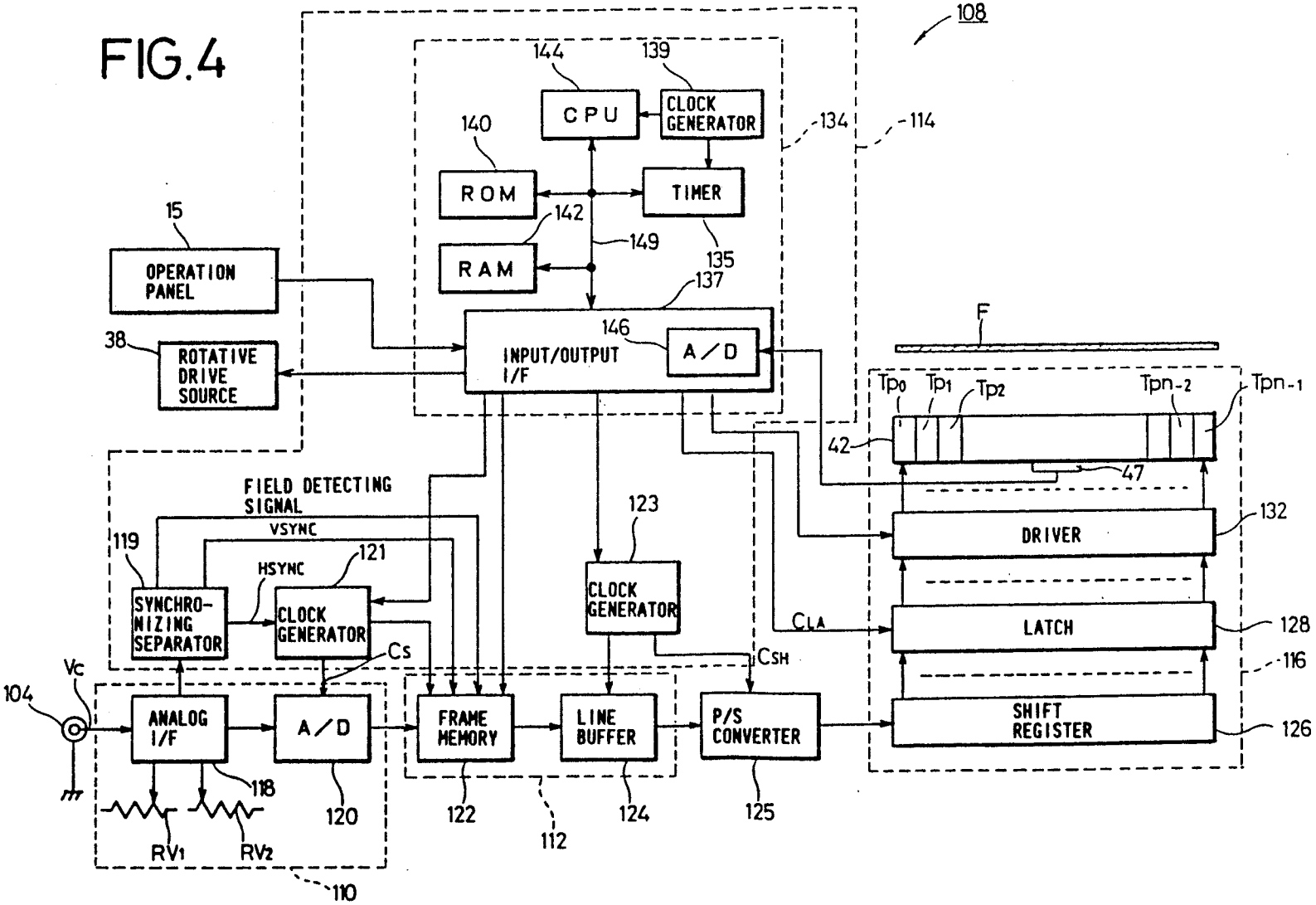
FIG. 4 is a block diagram of a thermal head drive system incorporated in the printer.

FIG. 4 schematically shows a thermal head drive system 108 which includes a portion of the control unit 28b. The thermal head drive system 108 basically comprises a video signal input unit 110, a video signal memory unit 112, a signal processing unit 114, and a thermal head drive unit 116 for driving the thermal head 42. The light-fixable heat-sensitive film F is held against the upper surface of the heating elements Tp0 through Tpn−1 of the thermal head 42.

In FIG. 4, a video signal Vc delivered from the video signal input terminal 104 is applied to the synchronizing separator 119 and an A/D converter 120 through an analog interface 118 to which rheostats $RV_1$, $RV_2$ are connected. The synchronizing separator 119 separates a field detecting signal, a VSYNC signal, and a HSYNC signal from the video signal Vc. The HSYNC signal triggers a voltage-controlled oscillator (VCO) (not shown) of a clock generator 121. A high-frequency pulse signal from the VCO is applied as a sampling clock signal to the A/D converter 120 and also as an address signal to a frame memory 122 of the video signal memory unit 112. The field detecting signal and the VSYNC signal are applied as address signals to the frame memory 122.

Video signals representing digital image data, which are produced by the A/D converter 120 per pulse of the sampling clock signal Cs synchronous with the HSYNC signal, are successively stored in the frame memory 122, which stores one frame of image data at a time, based on the field detecting signal, the VSYNC signal, and the high-frequency pulse signal. Then, one line of image data is delivered from the frame memory 122 to a line buffer memory 124.

An output signal from the line buffer memory 124 is applied Lo a shift register 126 of the thermal head drive system 116 through a parallel-to-serial converter (P/S converter) 125 in response to a clock signal from a clock generator 123. The shift register 126 comprises as many registers as the number of heating elements Tp0 through Tpn-1 of the thermal head 42, i.e., n registers. The shift register 126 applies parallel output signals to a latch 128 The latch 128 is controlled by a one-chip microcomputer 134 as a control means to hold the supplied signals over a predetermined period of time so as to effect a heat storage compensation process (described later on), and then supply the signals to a driver 132. The driver 132 applies parallel output signals, which have been compensated for by the heat storage compensation process, to the heating elements Tp0 through Tpn−1 of the thermal head 42.

If the input video signal Vc is an NTSC video signal, then an image is formed by hypothetical 492 scanning lines $l_1$ through $l_{492}$ in a printing area $L_0$ within a cut length L of light-fixable heat-sensitive film F. Thus, an image composed of the scanning lines $l_1$ through $l_{492}$ is thermally printed by the heating elements Tp0 through Tpn−1 of the thermal head 42.

Figure 5C:
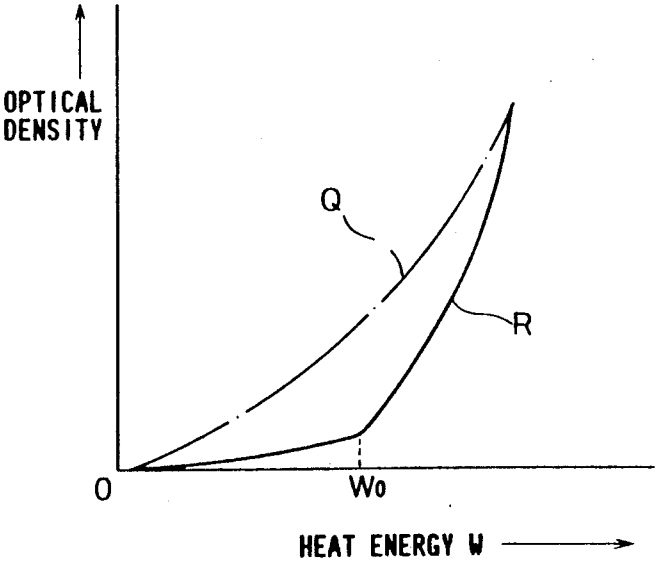
FIGS. 5*a* through 5*c* are diagrams illustrative of principles of recording an image on a light-fixable heat-sensitive film with a thermal head.
Figure 5A:
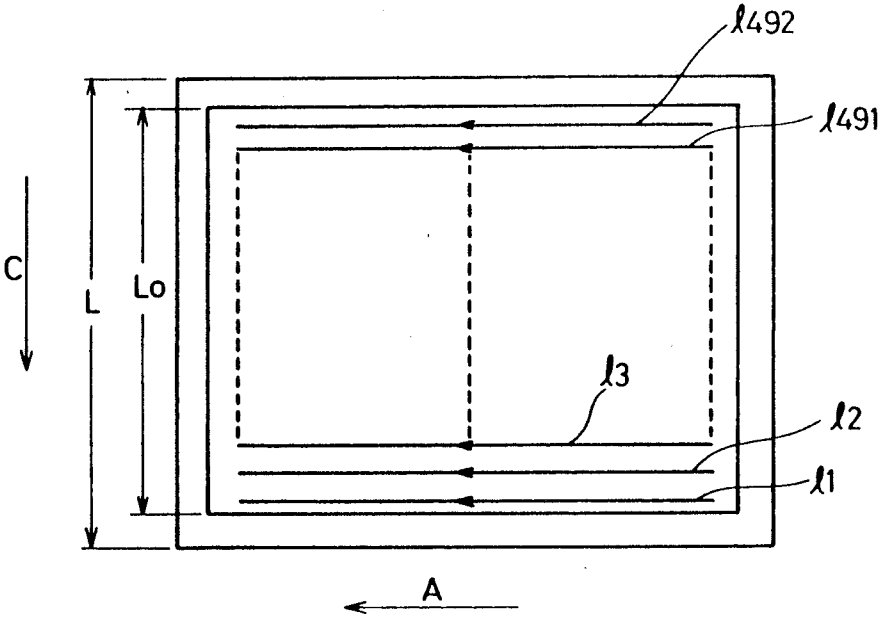
Figure 5B:
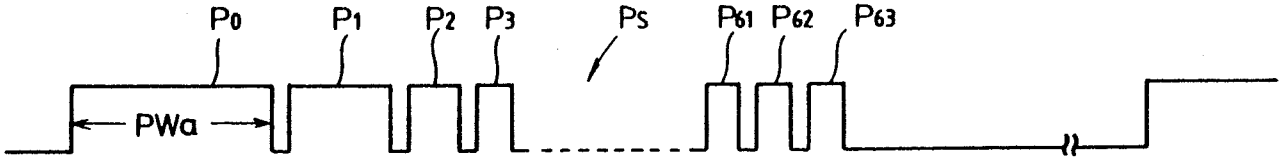

FIG. 5b shows standard pulses Ps supplied to the heating elements Tp0 through Tpn−1 for such thermal image printing. The standard pulses Ps are pulses for reproducing 64 gradations or tones, and comprise first through sixty-fourth pulse $P_0$ through $P_{63}$ corresponding to the gradations. The driver 132 generates a number of pulses up to the numbered pulse corresponding to the value of the signal applied to the shift register 126. For example, if the signal applied to the shift register 126 is of such a value which makes a certain register of the shift register 126 correspond to a value of ten, the pulses from the first pulse $P_0$ to the tenth pulse P9 are applied from the driver 132 to the heating element which corresponds to that certain register, reproducing the density of the tenth gradation on the light-fixable heat-sensitive film F.

Figures 6A, 6B, 6C:
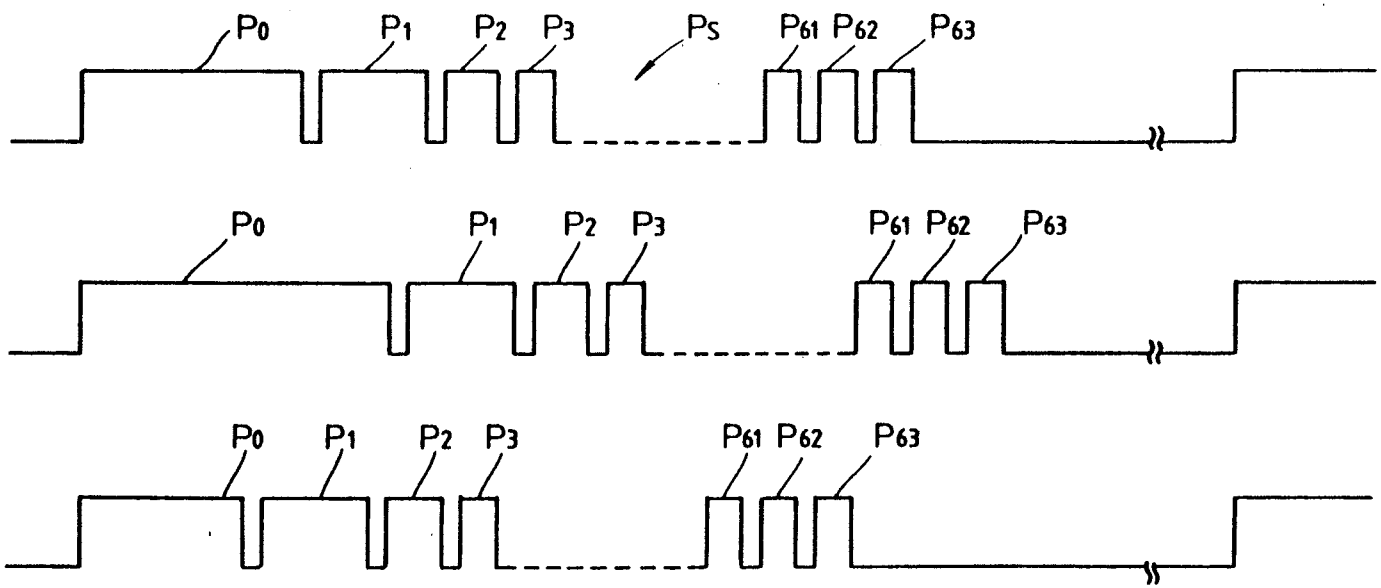
FIGS. 6*a* through 6*c* are timing charts schematically illustrating the method of driving a thermal head according to the present invention.

As shown in FIG. 5b, some of the pulses $P_0$ through $P_{63}$ of the standard pulses Ps have different pulse durations because the light-fixable heat-sensitive film F has dynamic color developing characteristics as indicated by R in FIG. 5c such that the density gradient is lower when the level of the heat energy given to the film F is lower and the density gradient becomes suddenly greater when the heat energy level is higher than an inflection point $W_0$. In order to match the dynamic color developing characteristics of the light-fixable heat-sensitive film F to the sensitivity characteristics (indicated by Q in FIG. 5c) of human eyes, the pulse durations of those pulses which are of low densities (on the lefthand side of FIG. 5b) are larger than those of the other pulses. In this embodiment, the light-fixable heat-sensitive film F does not develop any substantial color if only the first pulse $P_0$ is applied. Based on this property of the light-fixable heat-sensitive film F, even when the input signal applied to the shift register 126 is a signal corresponding to the density 0, at least the first pulse $P_0$ is supplied for thermal printing of the light-fixable heat-sensitive film F. Furthermore, the heat storage effect of the thermal head 42 is compensated for by increasing (if the temperature change is negative, see FIG. 6(*b*)) or reducing (if the temperature change is positive, see FIG. 6(*c*) the pulse duration of the first pulse $P_0$.

In FIG. 4, the clock generators 121, 123 accurately generate various clock pulses using a timer 135 under the control of the microcomputer 134. The operation panel 15 and the rotative drive source 38 are connected to an input/output interface 137 which includes an A/D converter 146. The input/output interface 137 transmits and receives data under the control of the microcomputer 134. The microcomputer 134 comprises the timer 135, the input/output interface 137, a clock generator 139, a ROM 140, a RAM 142, and a CPU 144. The components of the microcomputer 134, other than the clock generator 139, are electrically connected together by a bus line 149. The clock generator 139 is connected such that it applies clock pulses to the timer 135 and the CPU 144. The A/D converter 146 is connected to the temperature detector 47 which detects the temperature of the thermal head 42.

The thermal printer 10 is basically constructed as described above. Operation of the thermal printer 10 will now be described below.

The thermal printer 10 is connected through the video signal input terminal 104 through any of various medical imaging diagnostic systems (not shown) such as an X-ray CT system or an ultrasonic imaging system. The doctor or operator observes images displayed on the monitor of the medical imaging diagnostic system, and records a desired image on a light-fixable heat-sensitive film F as a hard copy.

When the grip 30 on the lid 14 is gripped and lifted, the hooks 32 are turned out of engagement with the casing 12, thereby unlocking the lid 14. After the lid 14 is turned upwardly into a vertical position, a roll of light-fixable heat-sensitive film F is loaded into the film loading unit 16. Then, the end of the light-fixable heat-sensitive film F is pulled out and drawn toward the cutter unit 20 (from the guide roller 54 if the arrangement shown in FIG. 2*b* is employed). The light-fixable heat-sensitive film F is now sandwiched under a prescribed pressure between the platen roller 36 supported on the lid 14 and the thermal head fixed to the bracket 46. The light-fixable heat-sensitive film F is also held by the guide roller 41 and also by the guide roller 54 (in the arrangement shown in FIG. 2*b*) on one or both sides of the platen roller 46.

The doctor or operator then operates on the operation panel 15 to enable the control units 28*a*, 28*b* to energize the rotative drive source 38. Rotative power of the rotative drive source 38 is transmitted through the gear train 40 to the platen roller 36, which rotates at a given speed in the direction indicated by the arrow B in FIG. 2*a*. Therefore, the light-fixable heat-sensitive film F sandwiched between the platen roller 36 and the thermal head 42 is fed in the auxiliary scanning direction indicated by the arrow C in FIG. 2*a*. At this time, the heating elements $Tp_0$ through $Tpn-1$ of the thermal head 42, which are arrayed along the main scanning direction indicated by the arrow A in FIG. 3, are selectively energized and heated according to an input video signal Vc by the thermal head drive system 108, thereby selectively developing color on the light-fixable heat-sensitive film F in the main scanning direction A. Accordingly, two-dimensional color development is effected on the light-fixable heat-sensitive film F which is fed in the auxiliary scanning direction C, so that a desired image is recorded on the light-fixable heat-sensitive film F.

The video signal Vc, which is introduced from the medical imaging diagnostic system through the video signal input terminal 104, is adjusted in video amplitude and pedestal level in the analog interface 118 by the rheostat RV1, RV2 so as to correspond to the full-scale voltage of the A/D converter 120 which is of 6 bits that is connected to an output terminal of the analog interface 118. Thereafter, the video signal Vc is supplied to the A/D converter 120 and the synchronizing separator 119.

Then, a field detecting signal, a VSYNC signal, and a HSYNC signal are separated from the video signal Vc by the synchronizing separator 119. The HSYNC signal triggers the VCO (not shown) of the clock generator 121. A high-frequency sampling signal generated by the VCO is applied as a sampling clock signal Cs to the clock input terminal of the A/D converter 120, which converts the video signal Vc into digital image data per pulse of the sampling clock signal Cs. The converted digital image data are successively stored at addresses in the frame memory 122 by address signals which correspond to the field detecting signal, the VSYNC signal, and the sampling clock signal Cs.

In this manner, one frame of image data is stored in the frame memory 122. The stored frame of image data is then delivered to the line buffer memory 124 per image data corresponding to one of the scanning lines $l_1$ through $l_{492}$ in the printing area $L_0$ (see FIG. 5*a*). The line of image data stored in the line buffer memory 124 is then transferred through the P/S converter 125 in a serial fashion into the shift register 126 per pulse of a shift clock signal $C_{SB}$ from the clock generator 123.

When image data for the first gradation corresponding to the heating elements Tp0 through $Tpn-1$, among the image data for one scanning line, are supplied to the shift register 126, the latch 128 is energized by a latch clock signal $C_{LA}$ from the microcomputer 134, latching the image data for the first gradation. After the image data for the first gradation have been latched, image data for the second radiation are then introduced from the line buffer memory 124 to the shift register 126. The image data for the first gradation which are applied at this time from the latch 128 to the driver 132 are all high in level (i.e., logic state "1").

A process of compensating for changes in the image density due to the heat storage effect of the thermal head 42 according to the pulse width modulation effected by the microcomputer 134, the latch 128, and the driver 132, will be described below.

Figure 7A:
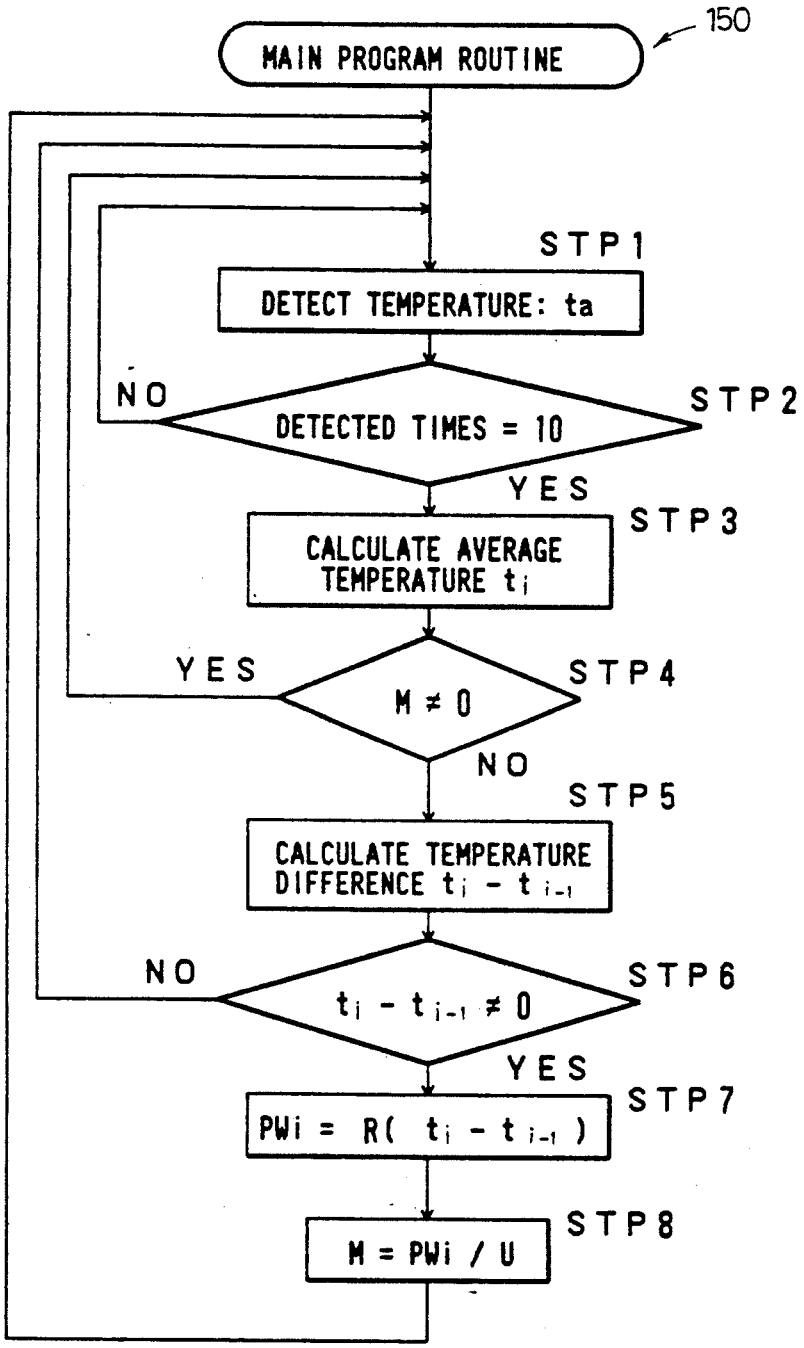
FIGS. 7*a* and 7*b* are flowcharts of a processing sequence of the method of driving a thermal head according to the present invention.
Figure 7B:
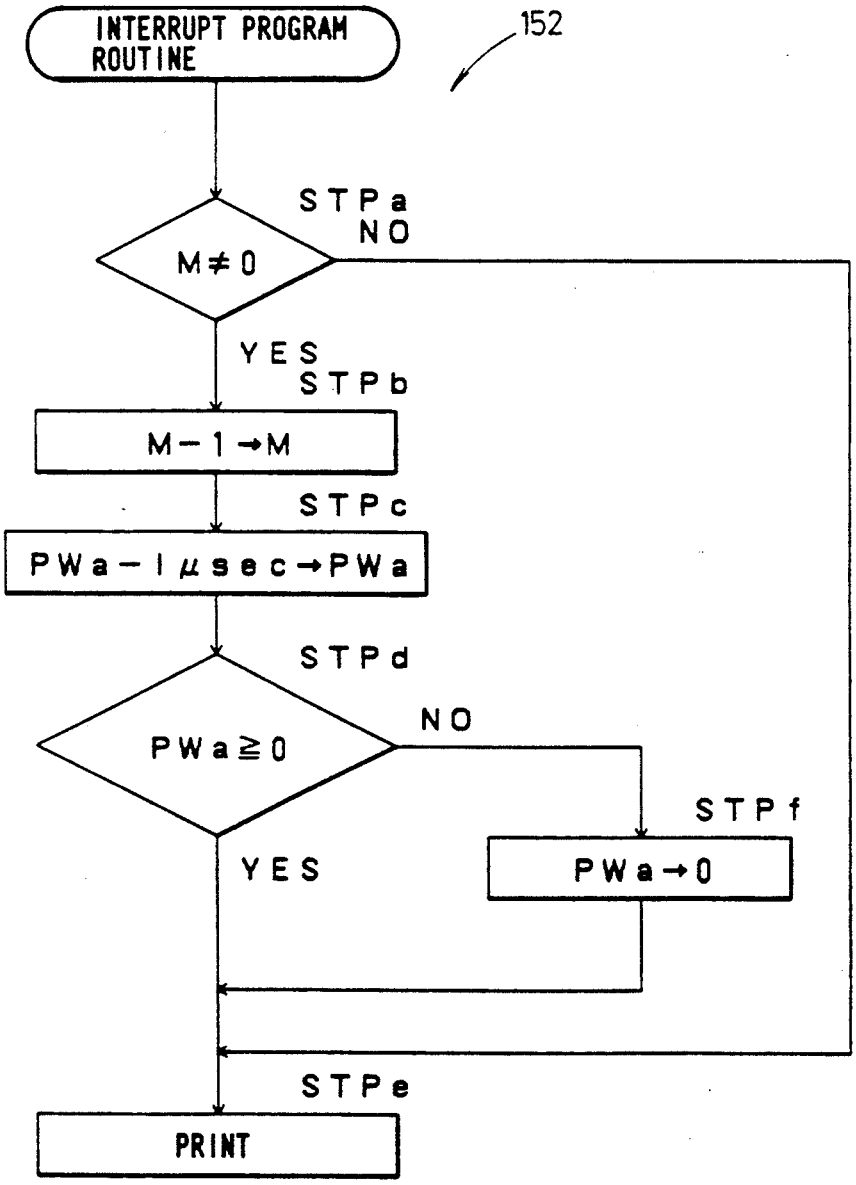
Figure 9:
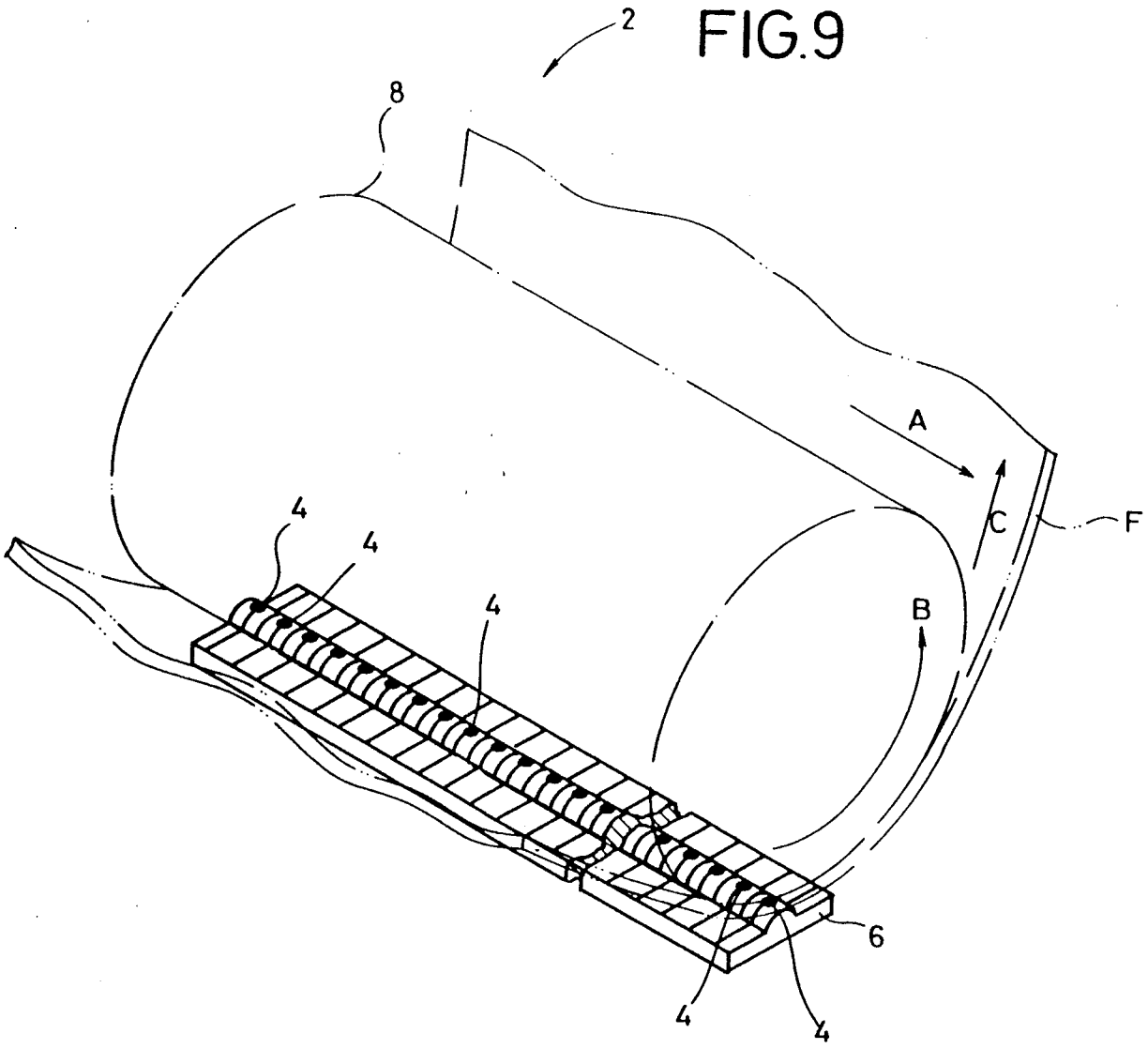
FIG. 9 is a perspective view illustrative of the manner in which an image is recorded by the thermal head.
Figures 10A, 10B:
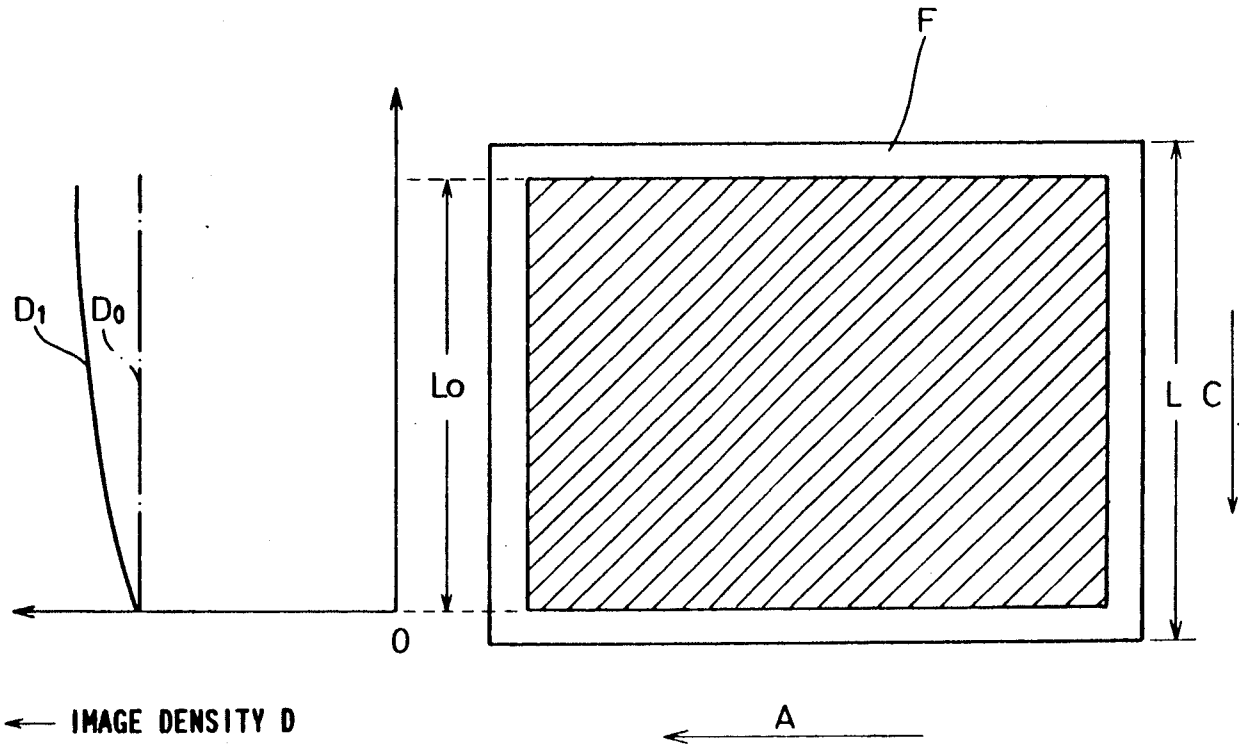
FIGS. 10*a* and 10*b* are diagrams showing the density distribution of an image reproduced by a conventional thermal head driving method.

FIGS. 7*a* and 7*b* show a main program routine 150 and an interrupt program routine 152, respectively, for the compensation of density changes due to the heat storage effect of the thermal head 42, the program routines 150, 152 being stored in the ROM 140. First, the temperature of the thermal head 42 is read according to an output signal from the temperature detector 47 in a step 1. Specifically, the output signal from the temperature detector 47 is applied through the A/D converter 146 of the input/output interface 137 to the CPU 144. The temperature represented by the applied output signal is stored as a temperature ta in the RAM 142. The temperature is detected and stored once per main scanning line.

Then, a step 2 determines whether the temperature ta is detected ten times. If detected ten times, then the average temperature $t_i$ of the temperatures ta is calculated and stored in the RAM 142 in a step 3. When the temperature ta is detected ten times and the average temperature $t_i$ is calculated, the preceding calculated average temperature is expressed as $t_{i-1}$.

Thereafter, a step 4 determines whether a preset scanning line number M regarding an increase or reduction in a pulse duration is set or not, i.e., whether it is 0 or not. The preset scanning line number M is the number of main scanning line within a predetermined length in the auxiliary scanning direction in order to gradually increase or reduce the pulse duration depending on a change in the temperature if such a temperature change is calculated in a next step 5. The density compensation is gradually effected with a plurality of main scanning line because if the condition that a temperature change $(t_i-t_{i-1})\neq 0$ is detected while a certain main scanning line is being printed, and if the pulse duration were varied once to the extent that is commensurate with the temperature change $(t_i-t_{i-1})$, then a density step or irregularity would be produced in the reproduced image.

If the preset main scanning line number M is not set in the step 4, then a temperature change $(t_i-t_{i-1})$ is calculated and stored in the RAM 142 in the step 5.

A step 6 then determines whether the temperature change $(t_i-t_{i-1})$ calculated in the step 5 is 0 or not. It is assumed in the present embodiment that the temperature change is 0.5° C. Therefore, control goes from the step 6 to a step 7 which determines a preset pulse duration PWi to be reduced depending on the temperature change $(t_i-t_{1-1})$. In this embodiment, the preset pulse duration PWi is determined to be 30 μsec. based on the following equation (1):

$$\begin{aligned} PWi &= R\,[\mu\text{sec}/^\circ\text{C.}] \times (t_i - t_{i-1})\,[^\circ\text{C.}] \\ &= 60\,[\mu\text{sec}/^\circ\text{C.}] \times (t_i - t_{i-1})\,[^\circ\text{C.}] \end{aligned} \quad (1)$$

where R is a constant indicative of a numerical value representing a reduction in the pulse duration per predetermined unit temperature. For example, if the video signal Vc is of a constant level, the constant R is obtained by driving the thermal head 42 so that the density of an image reproduced on the light-fixable heat-sensitive film F will be constant with respect to changes in the temperature of the thermal head 42. In this embodiment, the constant R=60 [μsec/° C.].

Then, the preset main scanning line number M is calculated according to the equation (2) given below. Since the preset pulse duration PWi is 30 μsec., the preset main scanning line number M is set as 30 in a step 8.

$$\begin{aligned} M &= \frac{PWi\,[\mu\text{sec}]}{U\,[\mu\text{sec}]} \\ &= \frac{PWi\,[\mu\text{sec}]}{1\,[\mu\text{sec}]} \end{aligned} \quad (2)$$

where U is a constant indicating a pulse duration (hereinafter referred to as a "unit pulse duration") to be varied per main scanning line. The constant U is predetermined so that any density step or irregularity on the reproduced image will be reduced upon density compensation. In this embodiment, the constant U is U=1 μsec.

The process of compensating for a change in the density due to the heat storage effect of the thermal head is carried out as follows: It is assumed that when a kth scanning line $l_k$ is printed with a pulse duration PWa of a first pulse $P_0$ (see FIG. 8 at (*a*)), a temperature change $(t_i-t_{i-1})=0.5°$ C. is detected, and a preset pulse duration PWi=30 μsec. and a preset main scanning line number M=30 are established. The pulse duration of the first pulse $P_0$ of a (k+1)th scanning line $l_{k+1}$ is now controlled to be (PWa−1 μsec) (see FIG. 8 at (*b*)). Likewise, the pulse duration of the first pulse $P_0$ is controlled so as to be (PWa−2 μsec), (PW1−3 μsec), . . . (PWa−30 μsec) depending on main scanning lines $l_{k+2}$, $l_{k+3}$, . . . $l_{k+30}$. The process of compensating for a change in the density due to the heat storage effect of the thermal head 42 is effected according to the interrupt program routine 152 shown in FIG. 7*b*.

The interrupt program routine 152 is executed per main scanning line.

First, a step a determines whether the preset main scanning line number M is 0 or not. Since the preset main scanning line number M is 30, control goes from the step a to a step b.

In the step b, 1 is subtracted from the preset main scanning line number M, and the difference is stored as the preset main scanning line number M in the RAM 142.

Then, the difference produced by subtracting the unit pulse duration 1 μsec. from the pulse duration PWa is stored as the pulse duration PWa in the RAM 142 in a step c.

Thereafter, a step d determines whether the preset pulse duration PWa produced in the step c is 0 or higher, or not.

If the pulse duration PWa is 0 or higher, then the printing process is carried out with the pulse duration (PWa−1 μsec) of the first pulse $P_0$ in a step e.

Then, the main program routine 150 is executed again. Since the preset main scanning line number M is set (M=30−1=29) in the step 4, the steps 5 through 8 are not executed, but the next interrupt program routine 152 is awaited. In the interrupt program routine 152, the steps a through e are executed, so that the printing process is carried out with the pulse duration (PWa−2 μsec) of the first pulse $P_0$.

In this manner, the pulse duration is reduced per scanning line until the preset scanning line number M becomes 0, i.e., the pulse duration PWa reaches (PWa−30 μsec) (see FIG. 8 at (*a*) through (*d*)). If the pulse duration PWa is below 0 in the step d in FIG. 7*b*, then the pulse duration PWa is set to 0 in a step f, and then the printing process is carried out.

In this embodiment, as described above, since the pulse duration is gradually reduced per main scanning line within a predetermined length in the auxiliary scanning direction when a positive temperature change is detected, no density step or irregularity is produced in the reproduced image. If the preset main scanning line number M is set to a value which is not 0, then the steps 5 through 8 of the main program routine 150 shown in FIG. 7*a* are not executed. Stated otherwise, while a compensation process is in progress, no new compensation process is effected. Accordingly, density gradations are smoothly corrected. While only the pulse duration of the first pulse $P_0$ is controlled, the pulse durations of all the 64 pulses may be controlled for density compensation.

The leading end of the light-fixable heat-sensitive film F on which one frame of image data has been recorded passes between the first and second cutter blades 56*a*, 56*b* of the cutter unit 20 while being guided by the guide plates 55*a*, 55*b*, and is then sent into the fixing unit 22 while being guided by the guide member 66. In the fixing unit 22, the ultraviolet lamps 68*a*, 68*b* are energized to apply ultraviolet radiation to the opposite surfaces of the light-fixable heat-sensitive film F. Since the lamp holders 70*a*, 70*b* are of a curved shape and have light reflecting layers 72*a*, 72*b*, respectively, on their inner surfaces, the ultraviolet radiation emitted from the ultraviolet lamps 68*a*, 68*b* is appropriately reflected by the light reflecting layers 72*a*, 72*b* for efficiently fixing the recorded image on the light-fixable heat-sensitive film F.

The leading end of the light-fixable heat-sensitive film F which is further fed from the fixing unit 22 toward the discharge unit 26 by the rotating platen roller 36 enters between the rubber roller 82 and the nip roller 84. The rubber roller 82 is then rotated in the direction indicated by the arrow by the rotative drive source (not shown), bringing the light-fixable heat-sensitive film F sandwiched between the rubber roller 82 and the nip roller 84 into contact with the charge erasing brush 92. Electrostatic charges on the light-fixable heat-sensitive film F are now removed by the charge erasing brush 92, after which the light-fixable heat-sensitive film F is discharged into the discharge tray 24.

After the light-fixable heat-sensitive film F has been fed to the discharge unit 26 by a predetermined length L, the second cutter blade 56*b* swings toward the first cutter blade 56*a*, jointly cutting off the light-fixable heat-sensitive film F. The cut length L of light-fixable heat-sensitive film F is now placed in the discharge tray 24 by the discharge unit 26. The light-fixable heat-sensitive film F placed in the discharge tray 24 will be used for a medical diagnosis, if necessary.

With the present invention, as described above, when a heat-sensitive film is printed by a thermal head, the pulse duration of a pulse supplied to the heating elements of the thermal head is varied depending on a change in the temperature of the thermal head. Therefore, changes in the image density of a reproduced image due to the heat storage effect of the thermal head can be removed, so that the entire image can be reproduced with density gradations corresponding to those of an input image signal. Since a highly accurate image free of unwanted image density irregularities can be reproduced, it allows the doctor or observer to effect a highly reliable medical diagnosis based on the reproduced image information.

Although certain preferred embodiments have bee shown and described, it should be understood that many changes and modifications may be made therein without departing from the scope of the appended claims.

What is claimed is:

1. A method of driving a thermal head in a printer, the thermal head having an array of heating elements along a main scanning direction, the heating elements being drivable by at least one pulse signal, said method two-dimensionally scans a heat-sensitive medium which is moved in an auxiliary scanning direction normal to the main scanning direction, thereby recording image information on the heat-sensitive medium, said method comprising the steps of:

calculating a change in an average temperature of the thermal head over a predetermined number of scanning lines; and thereafter, gradually increasing or reducing pulse duration of a pulse of said at least one pulse signal supplied to the heating elements a fixed amount per scanning line and over a number of scanning lines, said number being dependent upon the change in the average temperature calculated.

2. A method according to claim 1, wherein the average temperature of the thermal head is calculated while a plurality of the scanning lines are recorded by the thermal head, and the pulse duration is increased or reduced depending on the change in the average temperature.

3. A method according to claim 1, wherein after said pulse duration has been increased or decreased over said number of lines, the temperature change is again calculated and based thereon a new number of lines is determined over which said pulse duration is gradually increased or reduced said fixed amount per each of the lines.

4. A device for driving a thermal head in a printer, the thermal head having an array of heating elements along a main scanning direction, the heating elements being drivable by at least one pulse signal, said device two-dimensionally scans a heat-sensitive medium which is moved in an auxiliary scanning direction normal to the main scanning direction, thereby recording image information on the heat-sensitive medium, said device comprising:

temperature detecting means for detecting temperature of the thermal head; and control means for calculating a change in the average temperature detected over a predetermined number of scanning lines, and gradually increasing or reducing pulse duration of a pulse of said at least one pulse signal supplied to the heating elements a fixed amount per scanning line and over a number of scanning lines, said number being dependent upon the changes in average temperature calculated.

5. A method for producing an image on a heat-sensitive material by supplying pulse signals to a thermal head of a thermal printer for a plurality of scanning lines, said method comprising the steps of:

(a) detecting a temperature change in an average temperature of the thermal head over a predetermined number of the scanning lines;

(b) setting a number of the scanning lines to be modified based on the temperature change;

(c) sequentially decreasing or increasing pulse duration of one of the pulse signals by a unit pulse duration for the number of the scanning lines set in step (b) to produce modified pulse signals; and (d) producing the image on the heat-sensitive material by supplying the modified pulse signals to the thermal head.

6. A method according to claim 5, wherein the temperature change is detected prior to said setting in step (b), and wherein the number of scanning lines corresponds to a length of the heat-sensitive material.

7. A method for producing an image on a heat-sensitive film by supplying pulse signals to a thermal head of a printer for a plurality of scanning lines, the thermal head includes an array of heating elements each receiving at least one of the pulse signals, said method comprising the steps of:

(a) determining a present average temperature of the thermal head over a predetermined number of scanning lines;

(b) calculating a temperature change between the present average temperature and a previous average temperature of the thermal head;

(c) setting a number of the scanning lines to be modified based on the temperature change;

(d) sequentially decreasing or increasing pulse duration of one of the pulse signals by a unit pulse duration for the number of scanning lines set in step (c) to produce modified pulse signals which compensate for the temperature change in the thermal head; and (e) producing the image on the heat-sensitive film by supplying the modified pulse signals to the array of the heating elements.

8. A method according to claim 7, wherein the temperature change is calculated prior to said setting in step (c), and wherein the number of scanning lines corresponds to a length of the heat-sensitive film.

* * * * *

UNITED STATES PATENT AND TRADEMARK OFFICE

CERTIFICATE OF CORRECTION

PATENT NO. : 5,162,813
DATED : November 10, 1992
INVENTOR(S) : Yoshihiko, Kuroiwa, et. al.

It is certified that error appears in the above-indentified patent and that said Letters Patent is hereby corrected as shown below:

Title page, item [73], Assignee: should read--Nagano Nihon Musen Kabushiki Kaisha, Nagano, Japan--.

Signed and Sealed this

Sixth Day of May, 1997

*Attest:*

*Attesting Officer*

BRUCE LEHMAN

*Commissioner of Patents and Trademarks*